US005947684A

United States Patent [19]

Kato et al.

[11] Patent Number: 5,947,684

[45] Date of Patent: Sep. 7, 1999

[54] TURBOMACHINERY

[75] Inventors: Hiroyuki Kato, Yokohama; Shuichiro Honda, Kawasaki, both of Japan

[73] Assignee: Ebara Corporation, Tokyo, Japan

[21] Appl. No.: 08/826,334

[22] Filed: Mar. 27, 1997

[30] Foreign Application Priority Data

Mar. 29, 1996 [JP] Japan ..... 8-103583

[51] Int. Cl.[6] ..... F04D 19/00

[52] U.S. Cl. ..... 415/220; 415/200; 415/143; 29/447

[58] Field of Search ..... 415/220, 219.1, 415/182.1, 199.6, 200, 143; 29/889.21, 889.22, 447, 451, 434

[56] References Cited

U.S. PATENT DOCUMENTS

| | | | |
|---|---|---|---|
| 3,019,039 | 1/1962 | Clavell | 416/204 R |
| 3,163,119 | 12/1964 | Huppert et al. | 415/218.1 |
| 3,442,220 | 5/1969 | Mottram et al. | 415/143 |
| 3,604,819 | 9/1971 | Krahe | 416/204 |
| 4,580,943 | 4/1986 | Scully | 415/175 |
| 5,066,547 | 11/1991 | Ishida et al. | 428/627 |
| 5,425,618 | 6/1995 | Janigro et al. | 415/200 |
| 5,427,501 | 6/1995 | Chu | 415/143 |

FOREIGN PATENT DOCUMENTS

| | | |
|---|---|---|
| 2 274 807 | 1/1976 | France . |
| 1 541 795 | 3/1979 | United Kingdom . |

OTHER PUBLICATIONS

Patent Abstracts of Japan, vol. 011, No. 344 (M–640), Nov. 11, 1987 & JP 62 124829 A (Mitsubishi Heavy Ind. Ltd.), Jun. 6, 1987 * Abstract *.

U.S. Patent Application Serial No. 08/660,580, filed Jun. 11, 1996, Hiroyuki Kato et al., located in Group Art Unit 3209, entitled "Structure for Centering and Connecting Between Members".

*Primary Examiner*—Edward K. Look
*Assistant Examiner*—Richard Woo
*Attorney, Agent, or Firm*—Wenderoth, Lind & Ponack, L.L.P.

[57] ABSTRACT

A turbomachinery includes an attachment structure of an impeller to a rotational shaft which does not incur looseness even when it is subjected to temperature cycles, and which can be obtained without increasing manufacturing costs. The rotational shaft has the impeller at an end portion thereof. A cylindrical member is provided concentrically of the rotational shaft at the end portion for holding the impeller. The impeller is fitted inside the cylindrical member by shrink fitting.

40 Claims, 2 Drawing Sheets

TURBOMACHINERY

BACKGROUND OF THE INVENTION

1. Field of the Invention

The present invention relates to a turbomachinery such as a high temperature pump for pumping a high temperature liquid.

2. Description of the Related Art

In a type of a conventional motor pump for pumping a high temperature liquid, an axial flow impeller called an "inducer" is provided at a position upstream of a main centrifugal impeller. The inducer has a cylindrical body and vanes spirally provided on an outer surface of the cylindrical body, and is usually made of ceramics because of manufacturing convenience and good heat resisting properties.

The inducer is attached to the tip end of a metallic pump shaft in the motor pump in a following manner, for example. First, both ends of the inducer and the shaft are formed with radial mutually engageable grooves, then they are abutted to each other and fixed to each other by a fastening means such as bolts.

However, in a high temperature motor pump, the inducer is subjected to a temperature variance because it is heated by a high temperature liquid when it is operated to handle it and is cooled to a room temperature when it is not operated. As a result, the attachment of the inducer to the pump shaft may be loosened due to a difference between the expansion coefficients of the different materials, which may cause misalignment of the axes of the inducer and the motor shaft resulting in unfavorable operating conditions. Also, the conventional method requires much work for forming the engagement grooves both in the inducer and the motor shaft, leading to a high manufacturing cost.

SUMMARY OF THE INVENTION

It is therefore an object of the present invention to provide a turbomachinery having an attachment structure of an impeller to a rotational shaft which does not incur looseness even when it is subjected to temperature cycles, and which can be obtained without increasing manufacturing costs.

According to the present invention, there is provided a turbomachinery comprising: a casing for defining a chamber therein; a rotational shaft provided in the chamber and having an impeller at an end portion thereof; and a cylindrical member concentrically provided to the rotational shaft at the end portion for holding the impeller, wherein the impeller is fitted inside the cylindrical member by shrink fitting.

In an aspect of the invention, the impeller is made of ceramics and the cylindrical member is made of metal, and the impeller is fitted inside the cylindrical member by shrink fitting.

The above and other objects, features, and advantages of the present invention will become apparent from the following description when taken in conjunction with the accompanying drawings which illustrate a preferred embodiment of the present invention.

DETAILED DESCRIPTION OF THE PREFERRED EMBODIMENT

Figure 1:
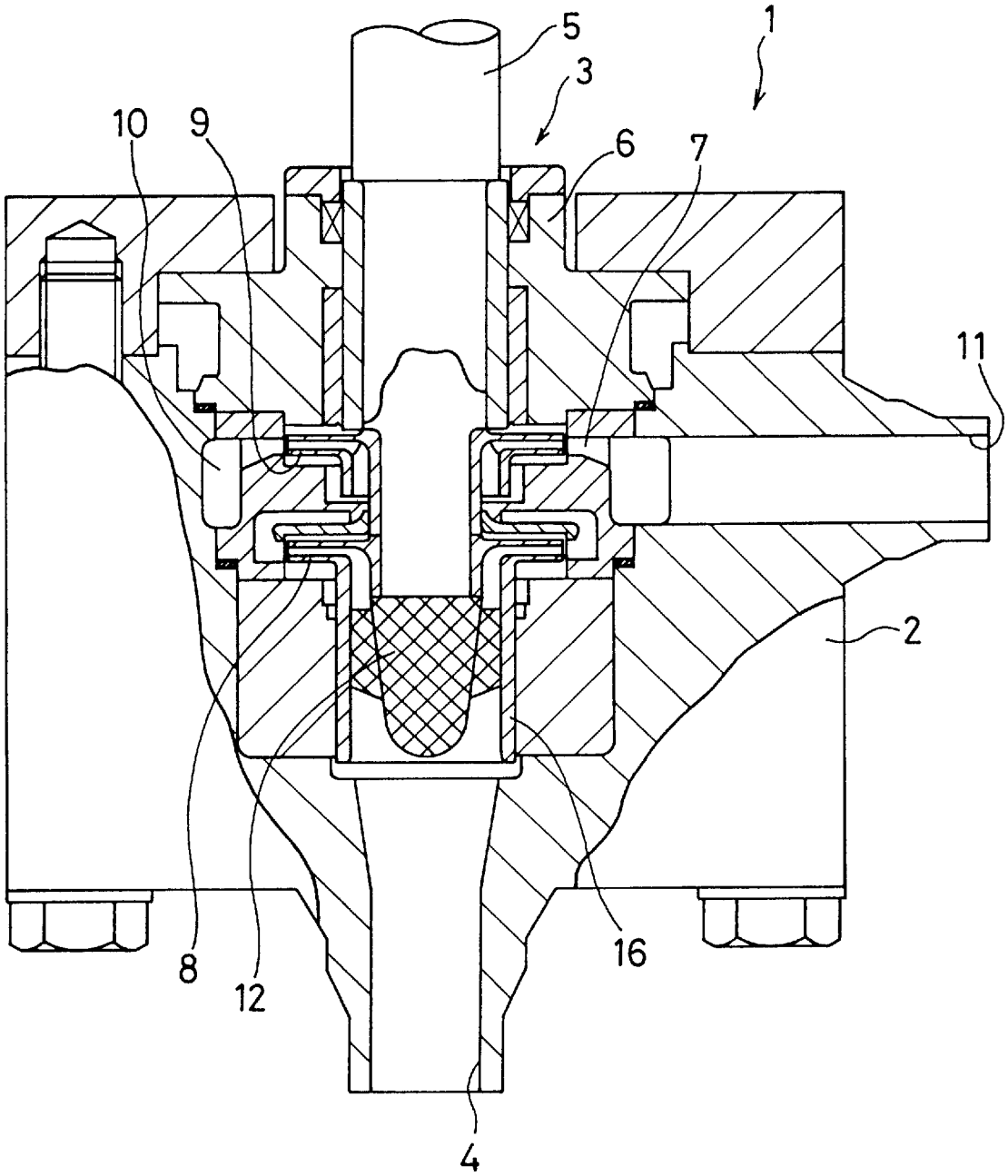
FIG. 1 is a vertical cross sectional view showing a pump portion of a high temperature motor pump of the present invention.
Figure 2:
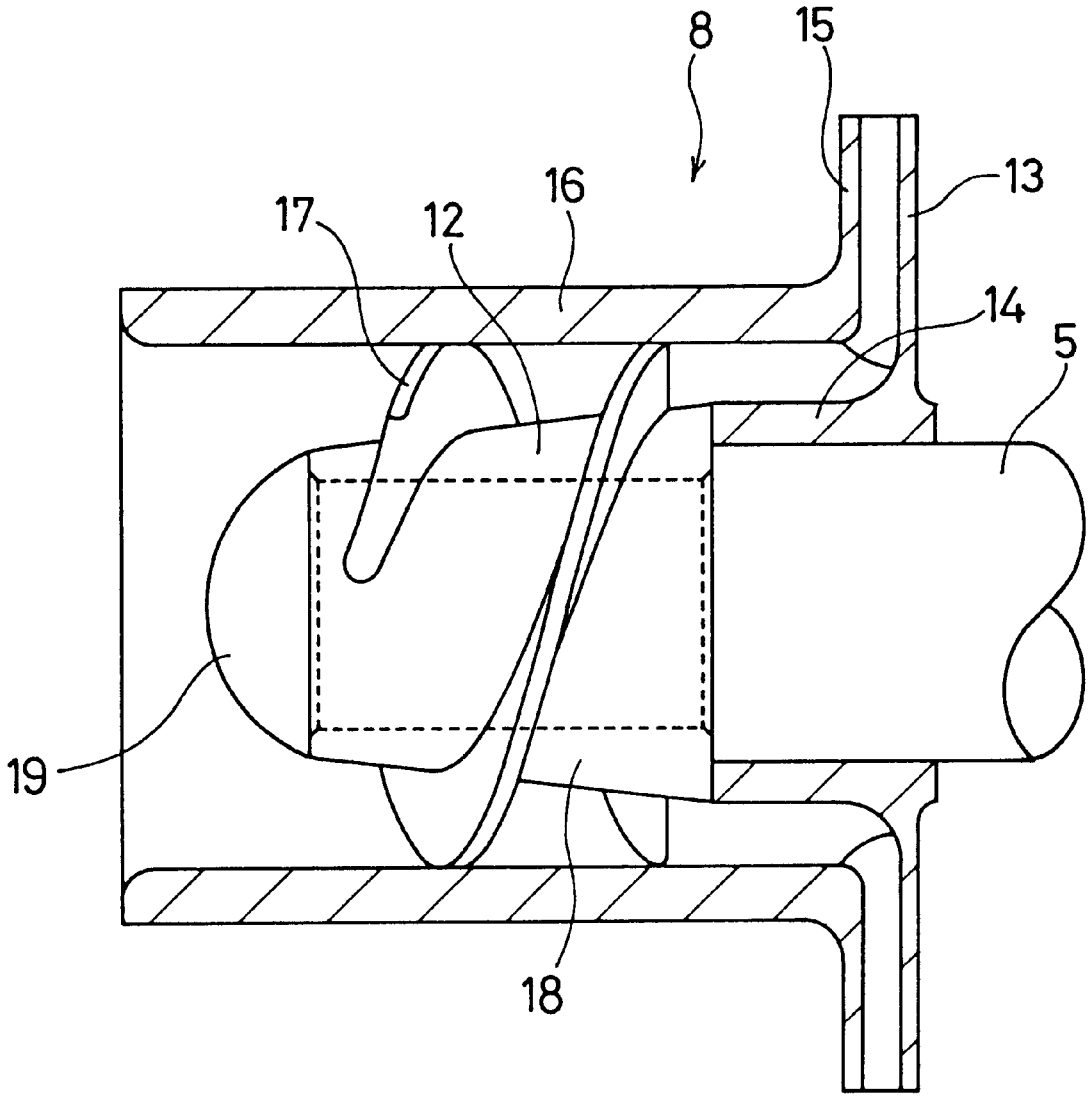
FIG. 2 is an enlarged view of a portion of FIG. 1.

FIGS. 1 and 2 show an embodiment of the present invention by way of describing a pump portion 1 of a high temperature motor pump.

The high temperature motor pump has the pump portion 1 for pumping a high temperature liquid, a motor portion (not shown) provided above the pump portion for driving the pump portion 1, and a magnetic bearing (not shown) provided above the motor portion for supporting a pump shaft.

The pump portion 1 has a pump casing 2 in which a vertically extending through hole 3 is defined, in which there is provided a pump shaft 5 which is integral with a motor shaft. The through hole 3 extends downward and opens to the exterior to define a suction inlet 4. Around the through hole 3, a bearing 6 is provided for supporting the pump shaft 5 at the upper portion of the casing 1, and a pump chamber 7 is defined below the bearing 6. In the pump chamber 7, a two-stage pump section is defined by two main impellers 8, 9 made of a metal material and attached to the pump shaft 5. Outside the second main impeller 9, there is provided a diffuser or a scroll section 10 spirally expanding and communicating with a discharge outlet 11. At the lower end of the pump shaft 5, an inducer (auxiliary impeller) 12 made of ceramic material is attached.

The first main impeller 8 comprises a main shroud 13 and a boss 14 integrally formed at the center of the main shroud 13. The pump shaft 5 is inserted in and secured to boss 14. The first main impeller 8 further comprises a front shroud 15 having a mouth ring portion 16 cylindrically shaped and axially extending from the front shroud 15 for defining a suction opening of the first impeller 8. The inducer 12 is provided with vanes 17 on the outer surface thereof, and is provided inside the mouth ring portion 16 and secured thereto by shrinkage fitting so that the outer edge surfaces of the vanes 17 abut with the inner surface of the mouth ring portion 16.

The inducer 12 comprises a cylindrical shaft portion 18 on which the vane 17 are provided and a capping portion 19 having a semi-spherical shape. The inducer 12 may be formed as a solid structure or the capping portion 19 may be formed integrally with the cylindrical shaft portion 18. Alignment grooves for aligning the inducer 12 and the first main impeller 8 may be formed on the mutually contacting surfaces of the distal end of the boss portion 14 and the proximal end of the inducer 12, or the inducer 12 may be connected to the main impeller 8 through a bolt.

Next, a method for providing the above attachment structure will be described. The outer diameter of the ceramic inducer and the inner diameter of the mouth ring portion 16 made of metal of the main impeller 8 are predetermined in a following manner. The stress applied between the inducer and the impeller is set large enough to hold the inducer 12 at a centered position without loosening at the expected maximum operational temperature of the pump, and sufficiently small to be less than the yield strength of both materials at the expected minimum operational temperature of the pump. The inducer 12 has a compression stress applied thereto, and the mouth ring portion 16 has a tensile stress applied thereto. Therefore, the present invention utilizes the mechanical strength characteristics of the ceramic material that, in general, has a larger compression stress than tensile stress.

The main impeller 8 having the mouth ring portion 16, in which the size is set as descried above, is gradually heated for enlarging the inner diameter thereof, and then the inducer 12 is inserted into the mouth ring portion 16. After that, the assembly is gradually cooled to a room temperature so that the main impeller 8 shrinks to fix the inducer 12 therein by shrinkage fitting while naturally aligning it at its center. After that, the boss portion 14 of the main impeller 8 is secured to the tip end of the shaft portion 18 by welding or other method such as the above mentioned shrinkage fitting.

It will be apparent therefore that impeller 8 essentially forms an attachment member including a cylindrical portion 14, 16 that is concentrically fit to shaft 5, with inducer 12 being shrunk fit inside such cylindrical portion. By such an attachment, if the inducer 12 is aligned with the mouth ring portion 16 and the main impeller 8 is aligned with the pump shaft 5, the inducer is also aligned with the pump shaft 5. Therefore, there are provided two attachments, i.e. 14/16 to 5 and 12 to 14/16, resulting in inducer 12 being concentrically fixed to shaft 5, both in circumferential and axial directions, by such attachment member. these two attachment structures are constructed by joining cylindrical faces, the centering operation can be naturally and easily carried out with a high degree of accuracy. Also, even when the main impeller 8 expands by being heated by the high temperature liquid handled by the pump, the inducer 12 is held in a centered position by the stress exerted to the impeller 8 and the inducer 12 without loosening. Further, while the pumping operation is off and thus at a low temperature, still the stress exerted to the impeller 8 and inducer 12 is sufficiently smaller than the yield strength of each material so that these portions are not subjected to breaking and fractures.

Next, an experimental example will be given for better understanding of the present invention. The inducer 12 having the shaft portion 18 and the vane 17 was made of ceramics in which silicon carbide is a main constituent. The main impeller 8 having the mouth ring portion 16 was made of Inconel 625. The inducer 12 was secured to the main impeller 8 by shrinkage fitting under the following conditions.

Material:

Inducer: Silicon carbide

Main impeller: Inconel 625

Outer diameter of inducer: 58 mm ø

Shrinkage fitting temperature: 300° C.

At 400° C., which is an expected maximum operation temperature, a compressive stress of 5 kg/mm$^2$ was applied to the inducer 12, which is sufficient to support the inducer while aligning it with the pump shaft 5.

At 20° C., which is an expected minimum operation temperature, a compressive stress of 45 kg/mm$^2$ was applied to the inducer, which is approximately 10% of the compressive strength of the material.

Although a certain preferred embodiment of the present invention has been shown and described in detail, it should be understood that various changes and modifications may be made therein without departing from the scope of the appended claims.

What is claimed is:

1. A turbomachinery comprising:

a casing defining therein a chamber;

a rotational shaft having an end portion extending into said chamber;

an attachment member fixed concentrically to said rotational shaft, said attachment member having a cylindrical portion extending axially beyond said end portion of said rotational shaft; and an impeller shrunk fit to an inside of said cylindrical portion and thereby being concentrically fixed to said rotational shaft in both axial and circumferential directions.

2. A turbomachinery as claimed in claim 1, wherein said impeller is made of ceramic material.

3. A turbomachinery as claimed in claim 1, wherein said cylindrical portion is made of metal material.

4. A turbomachinery as claimed in claim 1, wherein said impeller comprises a shaft portion and a vane portion provided on an outer surface of said shaft portion, and an outer surface of said vane portion is in abutment with an inner surface of said cylindrical portion.

5. A turbomachinery as claimed in claim 1, wherein said impeller comprises an axial flow impeller.

6. A turbomachinery as claimed in claim 1, wherein said attachment member comprises a main impeller positioned at a location downstream of said impeller.

7. A turbomachinery as claimed in claim 6, wherein said cylindrical portion extends from a front shroud of said main impeller.

8. A turbomachinery as claimed in claim 1, wherein a stress acting between said impeller and said cylindrical portion is as great as a stress therebetween necessary to insure fixing of said impeller to said cylindrical portion at an expected maximum operational temperature of said turbomachinery and smaller than yield strengths of said impeller and said cylindrical portion at an expected minimum operational temperature of said turbomachinery.

9. An assembly comprising:

a rotational shaft having an end portion;

an attachment member fixed concentrically to said rotational shaft, said attachment member having a cylindrical portion extending axially beyond said end portion of said rotational shaft; and an impeller shrunk fit to an inside of said cylindrical portion and thereby being concentrically fixed to said rotational shaft in both axial and circumferential directions.

10. An assembly as claimed in claim 9, wherein said impeller is made of ceramic material.

11. An assembly as claimed in claim 9, wherein said cylindrical portion is made of metal material.

12. An assembly as claimed in claim 9, wherein said impeller comprises a shaft portion and a vane portion provided on an outer surface of said shaft portion, and an outer surface of said vane portion is in abutment with an inner surface of said cylindrical portion.

13. An assembly as claimed in claim 9, wherein said impeller comprises an axial flow impeller.

14. An assembly as claimed in claim 9, wherein said attachment member comprises a main impeller positioned at a location downstream of said impeller.

15. An assembly as claimed in claim 14, wherein said cylindrical portion extends from a front shroud of said main impeller.

16. An assembly as claimed in claim 9, wherein a stress acting between said impeller and said cylindrical portion is as great as a stress therebetween necessary to insure fixing of said impeller to said cylindrical portion at an expected maximum operational temperature of said assembly and smaller than yield strengths of said impeller and said cylindrical portion at an expected minimum operational temperature of said assembly.

17. A method of fixing an impeller to an end portion of a rotational shaft of a pump, said method comprising:

fixing an attachment member having a cylindrical portion concentrically to said rotational shaft such that said cylindrical portion extends axially beyond said end portion of said rotational shaft; and shrink fitting said impeller to an inside of said cylindrical portion and thereby fixing said impeller to be concentric to said rotational shaft.

18. A method as claimed in claim 17, wherein said impeller is made of ceramic material.

19. A method as claimed in claim 17, wherein said cylindrical portion is made of metal material.

20. A method as claimed in claim 17, wherein said impeller comprises a shaft portion and a vane portion provided on an outer surface of said shaft portion, and an inner surface of said cylindrical portion is shrink fit against an outer surface of said vane portion.

21. A method as claimed in claim 17, wherein said shrink fitting comprises providing a stress acting between said impeller and said cylindrical portion is as great as a stress therebetween necessary to insure fixing of said impeller to said cylindrical portion at an expected maximum operational temperature of said pump and smaller than yield strengths of said impeller and said cylindrical portion at an expected minimum operational temperature of said pump.

22. A turbomachinery comprising:

a casing defining therein a chamber;

a rotational shaft having an end portion extending into said chamber;

an attachment member fixed concentrically to said rotational shaft, said attachment member having a cylindrical portion;

an impeller shrunk fit to an inside of said cylindrical portion and thereby being concentrically fixed to said rotational shaft in both axial and circumferential directions; and said attachment member comprising a main impeller positioned at a location downstream of said impeller.

23. A turbomachinery as claimed in claim 22, wherein said impeller is made of ceramic material.

24. A turbomachinery as claimed in claim 22, wherein said cylindrical portion is made of metal material.

25. A turbomachinery as claimed in claim 22, wherein said impeller comprises a shaft portion and a vane portion provided on an outer surface of said shaft portion, and an outer surface of said vane portion is in abutment with an inner surface of said cylindrical portion.

26. A turbomachinery as claimed in claim 22, wherein said impeller comprises an axial flow impeller.

27. A turbomachinery as claimed in claim 22, wherein said cylindrical portion extends from a front shroud of said main impeller.

28. A turbomachinery as claimed in claim 22, wherein a stress acting between said impeller and said cylindrical portion is as great as a stress therebetween necessary to insure fixing of said impeller to said cylindrical portion at an expected maximum operational temperature of said turbomachinery and smaller than yield strengths of said impeller and said cylindrical portion at an expected minimum operational temperature of said turbomachinery.

29. An assembly comprising:

a rotational shaft having an end portion;

an attachment member fixed concentrically to said rotational shaft, said attachment member having a cylindrical portion;

an impeller shrunk fit to an inside of said cylindrical portion and thereby being concentrically fixed to said rotational shaft in both axial and circumferential directions; and said attachment member comprising a main impeller positioned at a location downstream of said impeller.

30. An assembly as claimed in claim 29, wherein said impeller is made of ceramic material.

31. An assembly as claimed in claim 29, wherein said cylindrical portion is made of metal material.

32. An assembly as claimed in claim 29, wherein said impeller comprises a shaft portion and a vane portion provided on an outer surface of said shaft portion, and an outer surface of said vane portion is in abutment with an inner surface of said cylindrical portion.

33. An assembly as claimed in claim 29, wherein said impeller comprises an axial flow impeller.

34. An assembly as claimed in claim 29, wherein said cylindrical portion extends from a front shroud of said main impeller.

35. An assembly as claimed in claim 29, wherein a stress acting between said impeller and said cylindrical portion is as great as a stress therebetween necessary to insure fixing of said impeller to said cylindrical portion at an expected maximum operational temperature of said assembly and smaller than yield strengths of said impeller and said cylindrical portion at an expected minimum operational temperature of said assembly.

36. A method of fixing an impeller to an end portion of a rotational shaft of a pump, said method comprising:

fixing a main impeller, positioned at a location downstream of said impeller and having a cylindrical portion, concentrically to said rotational shaft; and shrink fitting said impeller to an inside of said cylindrical portion and thereby fixing said impeller to be concentric to said rotational shaft.

37. A method as claimed in claim 36, wherein said impeller is made of ceramic material.

38. A method as claimed in claim 36, wherein said cylindrical portion is made of metal material.

39. A method as claimed in claim 36, wherein said impeller comprises a shaft portion and a vane portion provided on an outer surface of said shaft portion, and an inner surface of said cylindrical portion is shrink fit against an outer surface of said vane portion.

40. A method as claimed in claim 36, wherein said shrink fitting comprises providing a stress acting between said impeller and said cylindrical portion is as great as a stress therebetween necessary to insure fixing of said impeller to said cylindrical portion at an expected maximum operational temperature of said pump and smaller than yield strengths of said impeller and said cylindrical portion at an expected minimum operational temperature of said pump.

* * * * *